US010018174B2

(12) United States Patent
Iida et al.

(10) Patent No.: US 10,018,174 B2
(45) Date of Patent: Jul. 10, 2018

(54) HYDRAULIC PUMP/MOTOR

(71) Applicant: Komatsu Ltd., Tokyo (JP)

(72) Inventors: Takeo Iida, Koga (JP); Hideaki Usami, Oyama (JP); Seiichi Hasegawa, Oyama (JP)

(73) Assignee: Komatsu Ltd., Tokyo (JP)

( * ) Notice: Subject to any disclaimer, the term of this patent is extended or adjusted under 35 U.S.C. 154(b) by 148 days.

(21) Appl. No.: 15/027,322

(22) PCT Filed: Oct. 31, 2014

(86) PCT No.: PCT/JP2014/079143
§ 371 (c)(1),
(2) Date: Apr. 5, 2016

(87) PCT Pub. No.: WO2016/067472
PCT Pub. Date: May 6, 2016

(65) Prior Publication Data
US 2016/0327015 A1 Nov. 10, 2016

(51) Int. Cl.
*F03C 1/06* (2006.01)
*F04B 1/20* (2006.01)
(Continued)

(52) U.S. Cl.
CPC ..... *F03C 1/0647* (2013.01); *F03C 1/0652* (2013.01); *F03C 1/0655* (2013.01);
(Continued)

(58) Field of Classification Search
CPC .... F04B 1/2042; F04B 1/2021; F04B 1/2035; F04B 1/126; F04B 1/188; F04B 1/2007;
(Continued)

(56) References Cited

U.S. PATENT DOCUMENTS 3,050,014 A 8/1962 Sullivan
3,208,397 A 9/1965 Lehrer et al.
(Continued)

FOREIGN PATENT DOCUMENTS

CN 1892032 A 1/2007
CN 102985691 A 3/2013
(Continued)

OTHER PUBLICATIONS

International Search Report and Written Opinion dated Jan. 27, 2015, issued for PCT/JP2014/079143.
(Continued)

*Primary Examiner* — Kenneth J Hansen
(74) *Attorney, Agent, or Firm* — Locke Lord LLP

(57) ABSTRACT

An axial-type hydraulic pump/motor in which a cylinder block with a plurality of cylinder bores formed around a rotation axis slides with respect to a valve plate that has a valve plate discharge port and a valve plate suction port, and controls the amount of reciprocation of a piston in each cylinder bore depending on the inclination of a swash plate. Based on the rotational direction of the cylinder block, an opening shape of an end portion on the front side in the rotational direction of a cylinder port and an opening shape of an end portion on the rear side in the rotational direction of the valve plate suction port PB1 have the same shape or partially have the same shape.

3 Claims, 10 Drawing Sheets

(51) Int. Cl.
*F03C 1/32* (2006.01)
*F03C 1/34* (2006.01)

(52) U.S. Cl.
CPC ..... *F04B 1/2021* (2013.01); *F04B 1/2035* (2013.01); *F04B 1/2042* (2013.01)

(58) Field of Classification Search
CPC .... F01B 3/0055; F01B 3/0047; F03C 1/0655; F03C 1/0686; F03C 1/0647
USPC ..... 91/485, 499
See application file for complete search history.

(56) References Cited

U.S. PATENT DOCUMENTS

| | | | | |
|---|---|---|---|---|
| 3,407,744 | A | 10/1968 | Slimm | |
| 3,890,883 | A | 6/1975 | Rometsch et al. | |
| 4,034,652 | A | 7/1977 | Huebner | |
| 5,247,869 | A | 9/1993 | Palmberg et al. | |
| 5,333,453 | A * | 8/1994 | Okuda ..... | F04B 1/2042 60/487 |
| 6,038,958 | A | 3/2000 | Raab | |
| 6,406,271 | B1 | 6/2002 | Valentin | |
| 8,794,124 | B2 | 8/2014 | Iida et al. | |
| 2005/0226748 | A1 | 10/2005 | Gray et al. | |
| 2007/0074626 | A1 | 4/2007 | Ferretti | |
| 2013/0152777 | A1 | 6/2013 | Iida et al. | |

FOREIGN PATENT DOCUMENTS

| | | | |
|---|---|---|---|
| CN | 103998779 | A | 8/2014 |
| DE | 1211943 | B | 3/1966 |
| DE | 2208890 | A | 9/1973 |
| DE | 4229544 | A1 | 3/1993 |
| DE | 69911386 | T2 | 7/2004 |
| JP | 41-018597 | U | 8/1966 |
| JP | 42-7216 | B | 3/1967 |
| JP | 43-2657 | B | 1/1968 |
| JP | 48-98403 | A | 12/1973 |
| JP | 51-111103 | U | 2/1976 |
| JP | 04-276188 | A | 10/1992 |
| JP | 04276188 | A | 10/1992 |
| JP | 2000-064950 | A | 3/2000 |
| JP | 3046374 | B2 | 3/2000 |

OTHER PUBLICATIONS

Office Action dated Jul. 18, 2017, issued for the German patent application No. 112014004909.3.

* cited by examiner

HYDRAULIC PUMP/MOTOR

FIELD

The present invention relates to an axial-type hydraulic pump/motor (hydraulic pump or hydraulic motor) in which a cylinder block with a plurality of cylinder bores formed around a rotation axis slides with respect to a valve plate that has a high-pressure port and a low-pressure port, and controls the amount of reciprocation of a piston in each of the cylinder bores depending on the inclination of a swash plate. In particular, the present invention relates to a hydraulic pump/motor that can suppress a reduction in suction capacity while rotation assistance capability due to a residual pressure inside a cylinder bore is increased when shifting from a discharging process (high-pressure process) to a suction process (low-pressure process).

BACKGROUND

Conventionally, in many cases, an axial-type hydraulic piston pump driven by an engine, and an axial-type hydraulic piston motor driven by a high-pressure working oil are used in construction machines, for example.

For example, the axial-type hydraulic piston pump includes a cylinder block, a plurality of pistons, and a valve plate. The cylinder block is provided so as to rotate integrally with a rotation shaft rotatably provided inside a case and is formed with a plurality of cylinders that are circumferentially apart from each other and extend axially. Each of the pistons is slidably fitted into the corresponding cylinder of the cylinder block, and sucks/discharges a working oil by moving axially in accordance with the rotation of the cylinder block. The valve plate is provided between the case and an end surface of the cylinder block, and is formed with a suction port and a discharge port that communicate with each of the cylinders. In the hydraulic piston pump, when a drive shaft is driven to rotate, the cylinder block, together with a working shaft, rotates inside the case, and each of the pistons reciprocates in the corresponding cylinder of the cylinder block. The working oil sucked into the cylinders from the suction port is pressurized by the pistons, and is discharged from the discharge port as a high-pressure working oil.

When the cylinder port of each cylinder communicates with the suction port of the valve plate, a suction process is performed. In the suction process, the pistons move between the start edge and the end edge of the suction port in a direction projecting from the cylinders, and suck the working oil into the cylinder from the suction port. When the cylinder port of each cylinder communicates with the discharge port, on the other hand, a discharging process is performed. In the discharging process, the pistons move between the start edge and the end edge of the discharge port in a direction entering into the cylinders, and discharge the working oil inside the cylinders into the discharge port. By rotating the cylinder block so as to repeat the suction process and the discharging process, the working oil sucked into the cylinders from the suction port during the suction process is pressurized and discharged to the discharge port during the discharging process.

CITATION LIST

Patent Literature

Patent Literature 1: Japanese Laid-open Patent Publication No. 2000-64950

SUMMARY

Technical Problem

In the conventional hydraulic pump described above or the like, the pressure inside the cylinders, from which the working oil has been discharged via the discharge port of the valve plate during the discharging process, is high.

Therefore, for example, in Patent Literature 1, a residual pressure extraction hole is provided, and causes the high-pressure working oil inside the cylinders to return to the suction port when shifting from the discharging process to the suction process. As a result, a change in the pressure of the working oil from the discharging process to the suction process becomes gentle, and causes the pressure of the working oil inside the cylinder and the pressure of the working oil inside the suction port to be the same when the cylinder port communicates with the suction port.

However, when shifting from the discharging process to the suction process, in a case where a residual pressure inside the cylinder is high, the rotation of the cylinder block is assisted and thus, the rotational efficiency is improved. Therefore, it is preferable that the rotation assist region, which is from a top dead point to the residual pressure extraction hole where the cylinder port communicates with, be increased in length in view of the rotational torque efficiency. However, when the rotation assist region is increased in length, an end portion on the side of the top dead point of the suction port shifts toward the side of a bottom dead point. As a result, the suction starting time at which the cylinder port communicates with the suction port is delayed, and the period of the overall suction process is shortened; therefore, the suction capacity in the suction process is reduced.

The present invention is made in view of the above, and an object thereof is to provide a hydraulic pump/motor that can suppress a reduction in suction capacity while rotation assistance capability due to a residual pressure inside a cylinder bore is increased when shifting from a discharging process to a suction process.

Solution to Problem

To resolve the above-described problem and attain the object, a hydraulic pump/motor according to the present invention is an axial-type hydraulic pump/motor in which a cylinder block with a plurality of cylinder bores formed around a rotation axis slides with respect to a valve plate that has a high-pressure port and a low-pressure port, and controls the amount of reciprocation of a piston in each of the cylinder bores depending on the inclination of a swash plate. Further, opening shapes of the high-pressure port and the low-pressure port extend circumferentially on the same arc centered around the rotation axis, and are annular band shapes that do not include a top dead point and a bottom dead point, an opening shape of a cylinder port in each of the cylinder bores extends circumferentially on the same arc where the high-pressure port and the low-pressure port are disposed, and is an annular band shape that does not communicate with the high-pressure port and the low-pressure port at least when positioned at the top dead point and the bottom dead point, and based on the rotational direction of the cylinder block: an opening shape of an end portion on the front side in the rotational direction of the cylinder port and an opening shape of an end portion on the rear side in the rotational direction of the low-pressure port partially have the same shape; and/or an opening shape of an end portion on the rear side in the rotational direction of the cylinder port and an opening shape of an end portion on the front side in the rotational direction of the low-pressure port partially have the same shape.

Further, in the hydraulic pump/motor according to the present invention, in the above invention, the opening shape of the end portion on the front side in the rotational direction of the cylinder port and the opening shape of the end portion on the rear side in the rotational direction of the low-pressure port have the same shape, and/or the opening shape of the end portion on the rear side in the rotational direction of the cylinder port and the opening shape of the end portion on the front side in the rotational direction of the low-pressure port have the same shape.

Further, in the hydraulic pump/motor according to the present invention, in the above invention, the opening shape of the end portion on the front side in the rotational direction of the cylinder port and an opening shape of an end portion on the rear side in the rotational direction of the high-pressure port partially have the same shape, and/or the opening shape of the end portion on the rear side in the rotational direction of the cylinder port and an opening shape of an end portion on the front side in the rotational direction of the high-pressure port partially have the same shape.

Further, in the hydraulic pump/motor according to the present invention, in the above invention, the opening shape of the end portion on the front side in the rotational direction of the cylinder port and the opening shape of the end portion on the rear side in the rotational direction of the high-pressure port have the same shape, and/or the opening shape of the end portion on the rear side in the rotational direction of the cylinder port and the opening shape of the end portion on the front side in the rotational direction of the high-pressure port have the same shape.

Further, the hydraulic pump/motor according to the present invention, in the above invention, further includes a residual pressure release port that is provided on the valve plate and communicates with the cylinder bore at the side of the top dead point before the cylinder bore at the side of the top dead point communicates with the low-pressure port. Further, opening portion of the end portion on the rear side in the rotational direction of the low-pressure port is separated from the top dead point so as to communicate with an opening portion of the end portion on the front side in the rotational direction of the cylinder port after the opening portion of the end portion on the front side in the rotational direction of the cylinder port passes a rotation assist region where the rotation of the cylinder block is assisted by a pressure oil inside the cylinder bore from a top dead point position of the cylinder port and a residual pressure release region where the pressure inside the cylinder bore is decreased by the communication between the residual pressure release port and the cylinder bore and to shift to a suction process.

Further, in the hydraulic pump/motor according to the present invention, in the above invention, at least one of an opening portion of the end portion on the front side in the rotational direction of the low-pressure port, an opening portion of the end portion on the rear side in the rotational direction of the high-pressure port, and an opening portion of the end portion on the front side in the rotational direction of the high-pressure port is formed at a position not communicating with the cylinder port only when the cylinder port is positioned at the top dead point or the bottom dead point.

Further, in the hydraulic pump/motor according to the present invention, in the above invention, the opening shape of the cylinder port is a cocoon-like annular band shape in which the end portions on the front side and the rear side in the rotational direction form arcs.

Further, in the hydraulic pump/motor according to the present invention, in the above invention, the opening shapes of the high-pressure port and the low-pressure port are cocoon-like annular band shapes in which the end portions on the front side and the rear side in the rotational directions form arcs.

Further, the hydraulic pump/motor according to the present invention is an axial-type hydraulic pump/motor in which a cylinder block with a plurality of cylinder bores formed around a rotation axis slides with respect to a valve plate that has a high-pressure port and a low-pressure port, and controls the amount of reciprocation of a piston in each of the cylinder bores depending on the inclination of a swash plate. Further, opening shapes of the high-pressure port and the low-pressure port extend circumferentially on the same arc centered around the rotation axis, and are annular band shapes that do not include a top dead point and a bottom dead point, an opening shape of a cylinder port in each of the cylinder bores extends circumferentially on the same arc where the high-pressure port and the low-pressure port are disposed, and is an annular band shape that does not communicate with the high-pressure port and the low-pressure port at least when positioned at the top dead point and the bottom dead point, and based on the rotational direction of the cylinder block: opening shapes of end portions on the front side and the rear side in the rotational direction of the cylinder port are circular convex shapes; opening shapes of end portions on the front side and the rear side in the rotational direction of the high-pressure port and an opening shape of an end portion on the front side in the rotational direction of the low-pressure port are circular convex shapes; an opening shape of an end portion on the rear side in the rotational direction of the low-pressure port is a circular concave shape; and the opening shape of the end portion on the front side in the rotational direction of the cylinder port and the opening shape of the end portion on the rear side in the rotational direction of the low-pressure port have the same shape.

Further, the hydraulic pump/motor according to the present invention is an axial-type hydraulic pump/motor in which a cylinder block with a plurality of cylinder bores formed around a rotation axis slides with respect to a valve plate that has a high-pressure port and a low-pressure port, and controls the amount of reciprocation of a piston in each of the cylinder bores depending on the inclination of a swash plate. Further, opening shapes of the high-pressure port and the low-pressure port extend circumferentially on the same arc centered around the rotation axis, and are annular band shapes that do not include a top dead point and a bottom dead point, an opening shape of a cylinder port in each of the cylinder bores extends circumferentially on the same arc where the high-pressure port and the low-pressure port are disposed, and is an annular band shape that does not communicate with the high-pressure port and the low-pressure port at least when positioned at the top dead point and the bottom dead point, and based on the rotational direction of the cylinder block: opening shapes of end portions on the front side and the rear side in the rotational direction of the cylinder port are circular convex shapes; an opening shape of an end portion on the front side in the rotational direction of the high-pressure port is a circular concave shape; opening shapes of end portions on the front side and the rear side in the rotational direction of the low-pressure port are circular concave shapes; the opening shape of the end portion on the front side in the rotational direction of the cylinder port and the opening shape of the end portion on the rear side in the rotational direction of the low-pressure port have the same shape; and the opening shape of the end portion on the rear side in the rotational direction of the cylinder port, the opening shape of the end portion on the front side in the rotational direction of the low-pressure port, and the opening shape of the end portion on the front side in the rotational direction of the high-pressure port have the same shape.

Advantageous Effects of Invention

According to the present invention, based on the rotational direction of a cylinder block, an opening shape of an end portion on the front side in the rotational direction of a cylinder port and an opening shape of an end portion on the rear side in the rotational direction of a low-pressure port partially have the same shape, and/or an opening shape of an end portion on the rear side in the rotational direction of the cylinder port and an opening shape of an end portion on the front side in the rotational direction of the low-pressure port partially have the same shape. As a result, an opening area of the low-pressure port becomes large and thus, the reduction in suction capacity can be suppressed while rotation assistance capability due to a residual pressure inside a cylinder bore is increased when shifting from a discharging process to a suction process.

DESCRIPTION OF EMBODIMENTS

In the following, a hydraulic pump/motor which is an embodiment of the present invention will be described with reference to the drawings.

Embodiment

[Entire Configuration of Hydraulic Pump]

Figure 1:
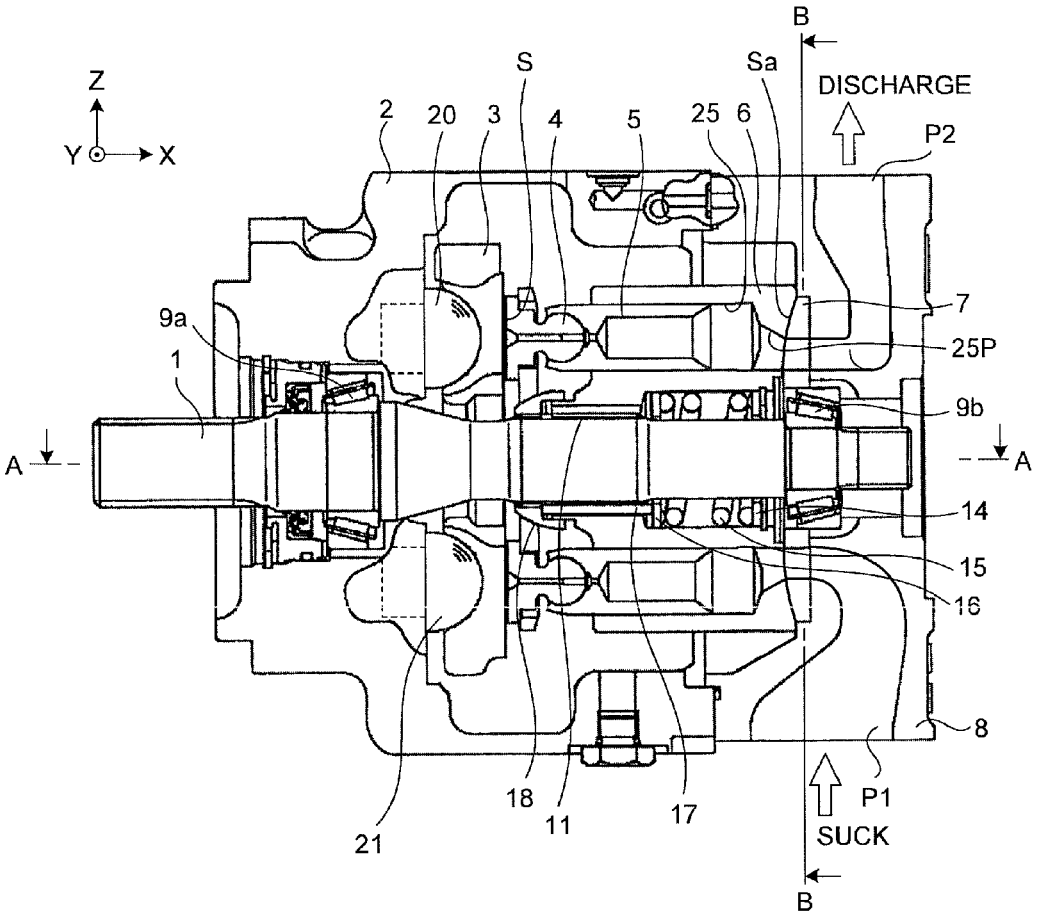
FIG. 1 is a sectional view illustrating a schematic configuration of a hydraulic pump according to an embodiment of the present invention.
Figure 2:
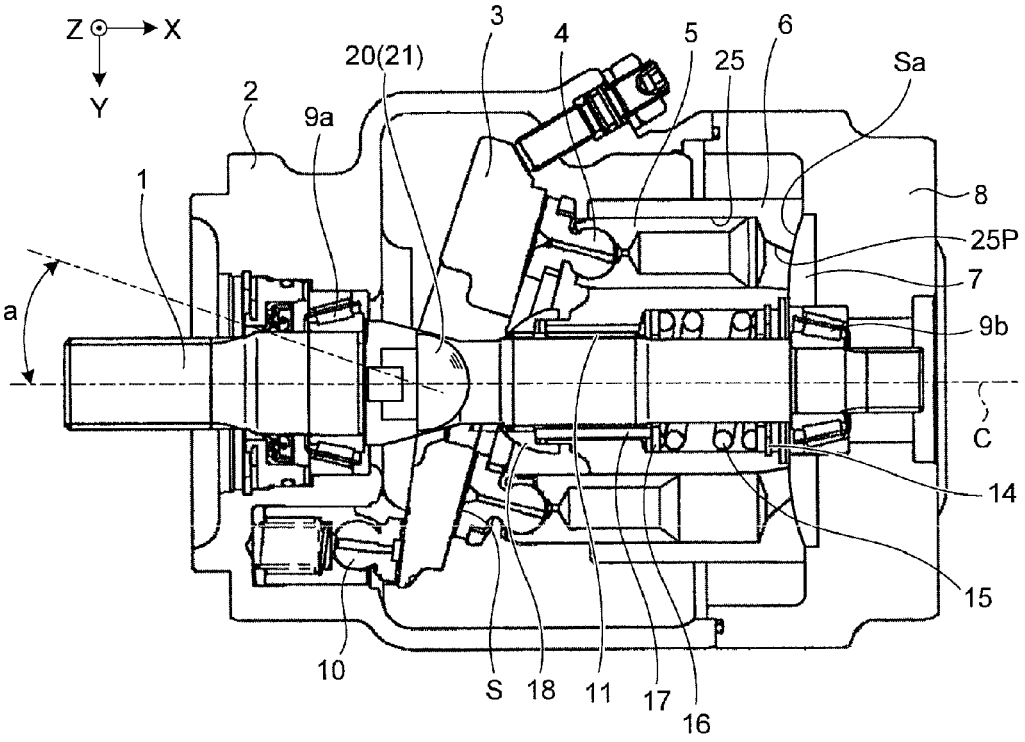
FIG. 2 is a line A-A cross-sectional view of the hydraulic pump illustrated in FIG. 1.

FIG. 1 is a sectional view illustrating a schematic configuration of a hydraulic pump according to a first embodiment of the present invention. FIG. 2 is a line A-A cross-sectional view of the hydraulic pump illustrated in FIG. 1. The hydraulic pump illustrated in FIGS. 1 and 2 converts the engine speed and the torque transmitted to a shaft 1 to hydraulic pressure and then, discharges oil, sucked in from a suction port P1, through a discharge port P2 as a high-pressure working oil. Furthermore, the hydraulic pump is a variable displacement hydraulic pump that can vary the discharge amount of the working oil from the pump by changing an inclination angle a of a swash plate 3.

Hereinafter, an axis along an axis C of the shaft 1 is referred to as an X-axis, an axis along an inclined central axis which is a line that connects fulcrums for the swash plate 3 to incline is referred to as a Z-axis, and an axis perpendicular to the X-axis and the Z-axis is referred to as a Y-axis. In addition, the direction from an end portion on an input side of the shaft 1 to an end portion on the opposite side is referred to as the X direction.

The hydraulic pump includes the shaft 1, a cylinder block 6, and the swash plate 3. The shaft 1 is rotatably and pivotally supported by a case 2 and an end cap 8 via bearings 9*a*, 9*b*, respectively. The cylinder block 6 is connected to the shaft 1 via a spline structure 11, and is driven to rotate integrally with the shaft 1 inside the case 2 and the end cap 8. The swash plate 3 is provided between a side wall of the case 2 and the cylinder block 6. The cylinder block 6 is provided with a plurality of piston cylinders (cylinder bores 25) disposed at equal intervals circumferentially about the axis C of the shaft 1 and in parallel to the axis C of the shaft 1. A piston 5 capable of reciprocating in parallel to the axis C of the shaft 1 is inserted into each of the plurality of cylinder bores 25.

The piston 5 that projects from each of the cylinder bores 25 has a spherical concave portion at the tip end thereof. A spherical convex portion of a shoe 4 fits into the spherical concave portion, and the piston 5 and the shoe 4 form a spherical shaft bearing. The spherical concave portion of the piston 5 is caulked and thus, the separation from the shoe 4 is prevented.

The swash plate 3 includes a flat sliding surface S on the side facing the cylinder block 6. The shoe 4, in accordance with the rotation of the cylinder block 6 interlocked with the rotation of the shaft 1, slides circularly or elliptically while being pressed against the sliding surface S. A spring 15, a movable ring 16, a needle 17, and a ring-shaped pressing member 18 are provided around the axis C of the shaft 1. The spring 15 is supported by a ring 14 provided on the inner periphery of the X direction side of the cylinder block 6. The movable ring 16 and the needle 17 are pressed by the spring 15. The pressing member 18 abuts on the needle 17. The shoe 4 is pressed against the sliding surface S by the pressing member 18.

On the side wall of the case 2, two hemispherical shaft bearings 20, 21 each projecting to face the side of the swash plate 3 are provided in symmetrical positions with respect to the axial center of the shaft 1. On the side of the side wall of the case 2 of the swash plate 3, two concave spheres are each formed on the portion corresponding to the positions where the shaft bearings 20, 21 have been disposed. A shaft bearing of the swash plate 3 is formed when the shaft bearings 20, 21 and two concave spheres of the swash plate 3 abut on each other. The shaft bearings 20, 21 are disposed in the Z-axis direction.

As illustrated in FIG. 2, the swash plate 3 inclines in a plane perpendicular to an X-Y plane using a line that connects the shaft bearings 20, 21 as an axis (parallel to the Z-axis). The inclination of the swash plate 3 is determined by a piston 10 that reciprocates while pressing one end of the swash plate 3 along the X direction from the side of the side wall of the case 2. The swash plate 3 inclines, by the reciprocation of the piston 10, using the line that connects the shaft bearings 20, 21 as a fulcrum. The sliding surface S also inclines due to the inclination of the swash plate 3 and thus, the cylinder block 6 rotates in accordance with the rotation of the shaft 1. For example, as illustrated in FIGS. 1 and 2, in a case where the inclination angle from an X-Z plane is a, when the cylinder block 6 rotates counterclockwise as viewed in the X direction, the shoe 4 slides circularly or elliptically along the sliding surface S and accordingly, the piston 5 inside each of the cylinder bores 25 reciprocates.

When the piston 5 moves to the side of the swash plate 3, the oil is sucked from a suction port P1 into each of the cylinder bores 25 via a valve plate 7. When the piston 5 moves to the side of the valve plate 7, the oil inside each of the cylinder bores 25 is discharged, via the valve plate 7, from the discharge port P2 as a high-pressure working oil. The amount of the working oil discharged from the discharge port P2 is variably controlled by adjusting the inclination of the swash plate 3.

[Configuration of Valve Plate and Cylinder Block]

Figure 3:
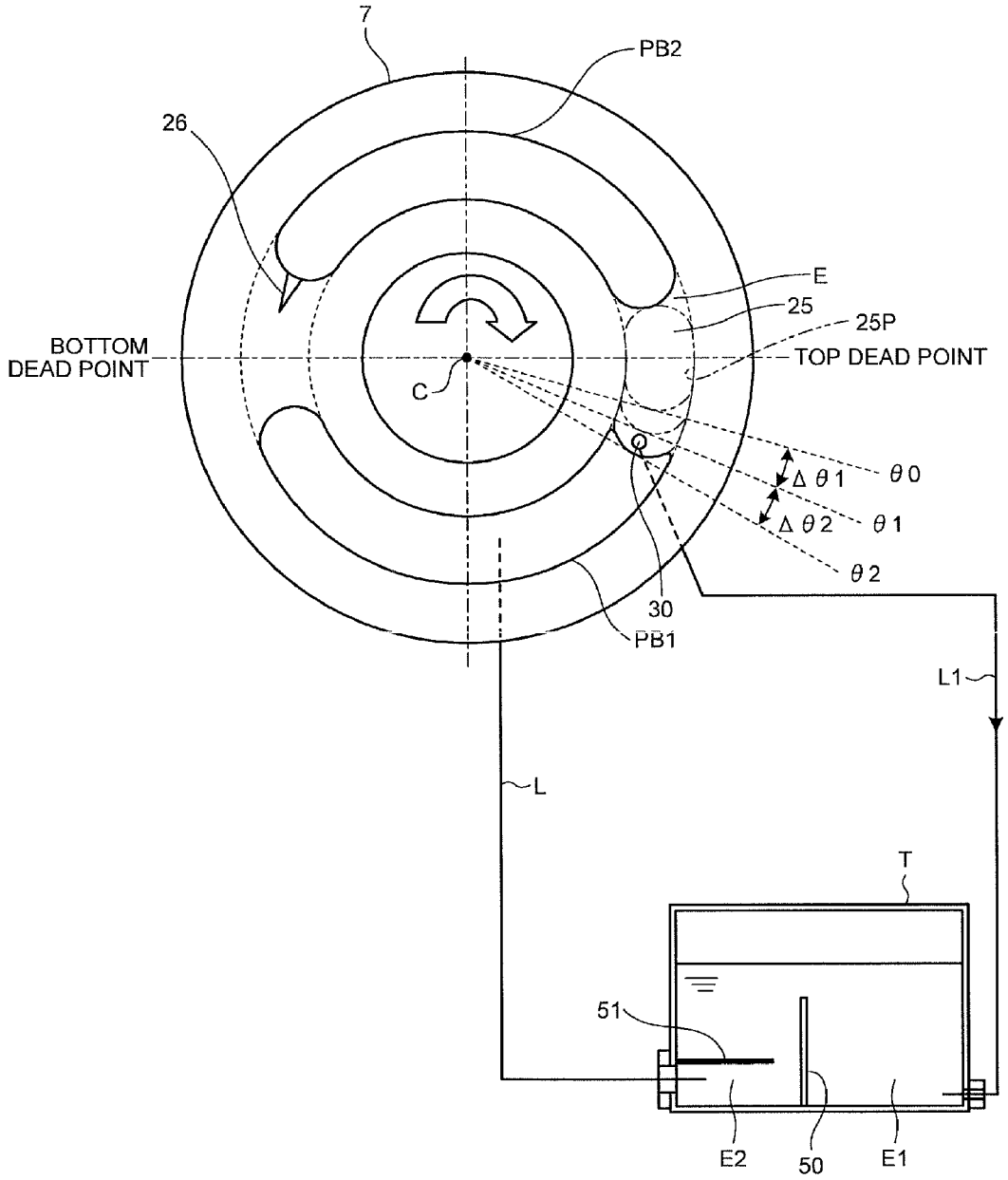
FIG. 3 is a view illustrating a line B-B cross section of the hydraulic pump illustrated in FIG. 1 and a cross section of a working oil tank connected to the hydraulic pump.
Figure 4:
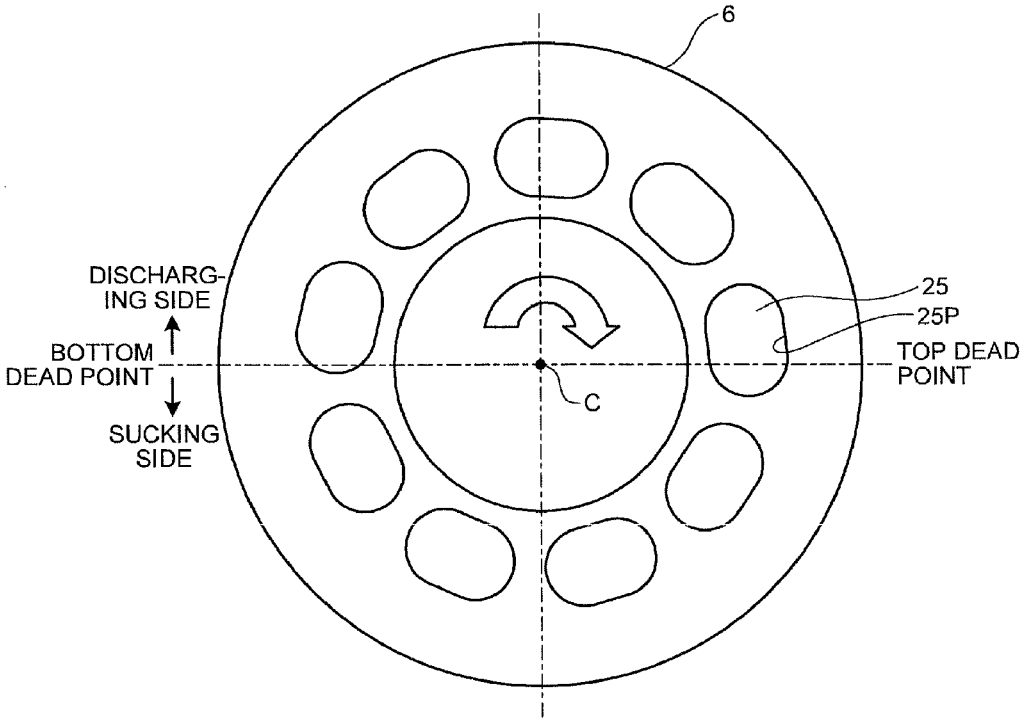
FIG. 4 is a view illustrating a configuration of a sliding surface of a cylinder block with respect to a valve plate when viewed in the −X direction.

The valve plate 7 fixed to the side of the end cap 8 and the cylinder block 6 which rotates are in contact with each other via a sliding surface Sa. FIG. 3 is a line B-B cross-sectional view of the hydraulic pump illustrated in FIG. 1. FIG. 4 is a view illustrating a configuration of the sliding surface Sa of the cylinder block 6 with respect to the valve plate 7 when viewed in the −X direction. An end surface on the side of the sliding surface Sa of the valve plate 7 and an end surface on the side of the sliding surface Sa of the cylinder block 6 illustrated in FIGS. 3 and 4 slide over each other by the rotation of the cylinder block 6.

As illustrated in FIG. 3, the valve plate 7 includes a valve plate suction port PB1 that communicates with the suction port P1, and a valve plate discharge port PB2 that communicates with the discharge port P2. Opening shapes of the valve plate suction port PB1 and the valve plate discharge port PB2 extend circumferentially on the same arc centered around the rotation axis C, and are annular band shapes that do not include a top dead point and a bottom dead point. As illustrated in FIG. 4, the ports of the nine cylinder bores 25 (cylinder ports 25P) where the piston 5 reciprocates are provided on the side of the sliding surface Sa of the cylinder block 6 at equal intervals and on the same arc where the valve plate suction port PB1 and the valve plate discharge port PB2 are disposed. An opening shape of the cylinder port 25P extends circumferentially on the same arc where the valve plate suction port PB1 and the valve plate discharge port PB2 are disposed, and is an annular band shape that does not communicate with the valve plate suction port PB1 and the valve plate discharge port PB2 when positioned at the top dead point and the bottom dead point.

In FIGS. 3 and 4, when the cylinder block 6 rotates clockwise as viewed in a direction toward the −X direction, as in FIG. 3, the discharging process is performed on the side of the valve plate discharge port PB2 which is at the upper side of the drawing, and the suction process is performed on the side of the valve plate suction port PB1 which is at the lower side of the drawing. Accordingly, in such case, the right end side of the drawing in FIG. 3 becomes the top dead point where the discharging process has switched to the suction process and where the piston 5 has entered maximally to the side of the sliding surface Sa inside the cylinder bore 25. The high-pressure state inside the cylinder bore 25 shifts to the low-pressure state. On the other hand, the left end side of the drawing in FIG. 3 becomes the bottom dead point where the suction process has switched to the discharging process and where the piston 5 has moved furthest away from the side of the sliding surface Sa inside the cylinder bore 25. When the cylinder port 25P passes the bottom dead point, the low-pressure state shifts to the high-pressure state.

As illustrated in FIG. 3, a notch 26 is provided in the valve plate 7. The notch 26 is provided so as to extend from the end portion of the valve plate discharge port PB2 on the side of the bottom dead point to the side of the bottom dead point. The notch 26 has a function of regulating the self-pressure of the cylinder bore 25 before the cylinder bore 25 communicates with the valve plate discharge port PB2. By providing the notch 26, the pressure inside the cylinder bore 25 gradually gets close to the pressure inside the valve plate discharge port PB2 right before the cylinder bore 25 communicates with the valve plate discharge port PB2. Consequently, the erosion and noise of the cylinder bore 25 caused when the cylinder bore 25 communicates with the valve plate discharge port PB2 are suppressed.

As illustrated in FIG. 3, a residual pressure release port 30 is provided in the valve plate 7. The residual pressure release port 30 is provided in a region within a rotational movement region E of the cylinder port 25P and from the vicinity of the top dead point to the valve plate suction port PB1. The residual pressure release port 30 is provided at a position being able to communicate with the cylinder bore 25 before the cylinder bore 25 communicates with the valve plate suction port PB1. The residual pressure release port 30 is connected to a working oil tank T via a flow path L1. The working oil tank T is connected to the valve plate suction port PB1 via a flow path L.

The working oil tank T is provided with a partition plate 50 that partitions the working oil into regions E1, E2 in the horizontal direction. The working oil, inside the cylinder bore 25, which contains a large amount of air flows into the region E1 via the flow path L1. The working oil is supplied from the region E2 to the valve plate suction port PB1 via the flow path L. The air in the working oil that has flowed into the region E1 is removed in the region E1. The clean working oil with the air reduced in the region E1 flows into the region E2 via the upper portion of the partition plate 50. In the region E2, a shielding plate 51 that extends horizontally is provided at the upper portion of an outlet port for the working oil. By providing the shielding plate 51, the clean working oil that does not contain settled dust or the like is supplied to the side of the valve plate suction port PB1.

From a position where the cylinder port 25P is at the top dead point, that is, a position where the circumferential tip end of the cylinder port 25P in the rotation direction is at an angle θ0, to a position where the cylinder bore 25 communicates with the residual pressure release port 30 (rotation assist region Δθ1), the rotation of the cylinder block 6 is assisted by the compressed working oil inside the cylinder bore 25. Conventionally, the working oil in the suction port P1 is assisted using an impeller (not illustrated) that uses the rotational force of the shaft 1; however, depending on the types of devices, there is a case where the impeller does not have to be used by performing the rotation assist. Therefore, by performing the rotation assist as much as possible, energy efficiency can be improved while the structure becomes simple.

Thereafter, until the circumferential tip end of the cylinder port 25P passes an angle θ1 and the cylinder bore 25 communicates with the residual pressure release port 30, and the cylinder bore 25 communicates with the valve plate suction port PB1 when the circumferential tip end of the cylinder port 25P is at an angle θ2 (residual pressure release region Δθ2), the compressed working oil inside the cylinder bore 25 flows into the working oil tank T via the residual pressure release port 30 and the flow path L1. As a result, a residual pressure inside the cylinder bore 25 is decreased.

[Opening Shapes of Cylinder Port and Valve Plate Suction Port]

Figure 5:
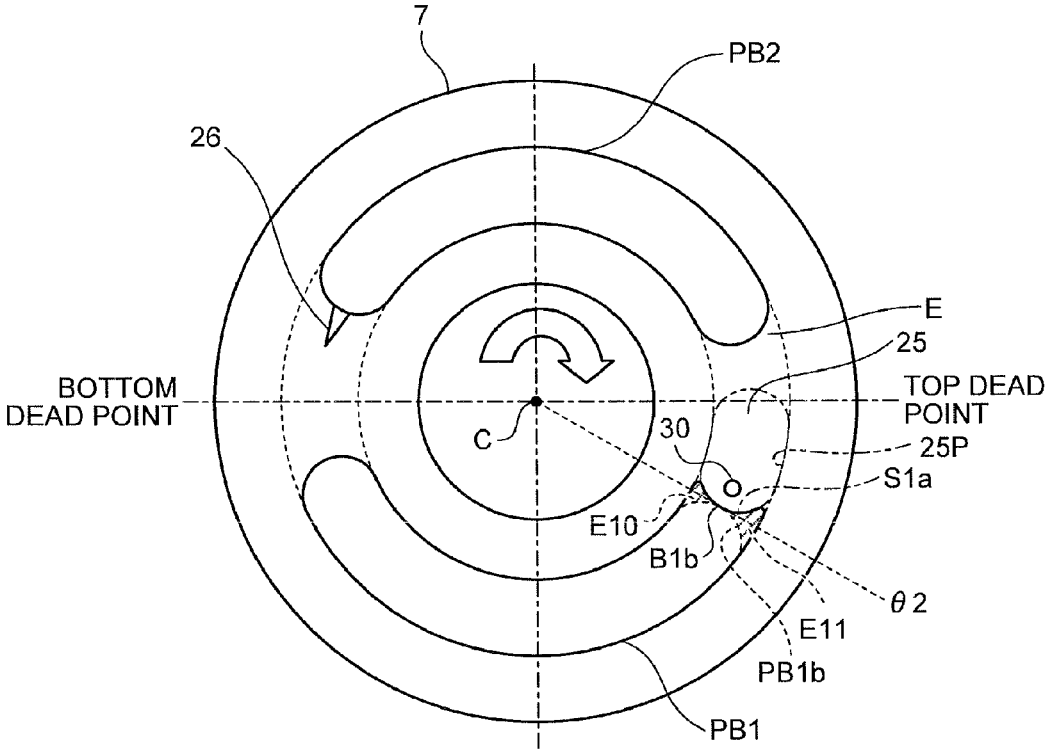
FIG. 5 is a view illustrating opening shapes of a valve plate suction port and a valve plate discharge port of the valve plate with respect to a cylinder port illustrated in FIG. 3.

As illustrated in FIG. 5, an opening shape PB1*b* of an end portion on the rear side in the rotational direction of a conventional valve plate suction port PB1 has an arc projecting toward the rear end side. Similarly, an opening shape S1*a* of an end portion on the front side in the rotational direction of the cylinder port 25P has an arc projecting toward the tip end side. Therefore, when the cylinder port 25P communicates with the valve plate suction port PB1 at the angle θ2, they contact each other at a point and the communicating area has been enlarged gradually in accordance with the rotation of the cylinder block 6.

In the present embodiment, the opening shape PB1*b* of the end portion on the rear side in the rotational direction of the valve plate suction port PB1 is an opening shape B1*b* of an end portion on the rear side in the rotational direction thereof. In addition, the opening shape B1*b* of the end portion on the rear side in the rotational direction and the opening shape S1*a* of the end portion on the front side in the rotational direction have the same shape. That is, when the cylinder port 25P communicates with the valve plate suction port PB1 in accordance with the rotation of the cylinder block 6, the opening shape S1*a* of the end portion on the front side in the rotational direction of the cylinder port 25P and the opening shape B1*b* of the end portion on the rear side in the rotational direction of the valve plate suction port PB1 overlap. As a result, in comparison with the past, the suction capacity in the suction process can be increased by the area of regions E10, E11 illustrated by diagonal lines. That is, it is possible to suppress the reduction in suction capacity even if the rotation assist region Δθ1 is set larger in comparison with the past.

When the cylinder port 25P communicates with the valve plate suction port PB1, the opening shape B1*b* of the end portion on the rear side in the rotational direction of the valve plate suction port PB1 and the opening shape S1*a* of the end portion on the front side in the rotational direction of the cylinder port 25P may partially have the same shape and partially overlap.

Both end portions in the radial direction of the opening shape B1*b* of the end portion on the rear side in the rotational direction of the valve plate suction port PB1 are chamfered by the end mill processing.

(First Modification)

Figure 6:
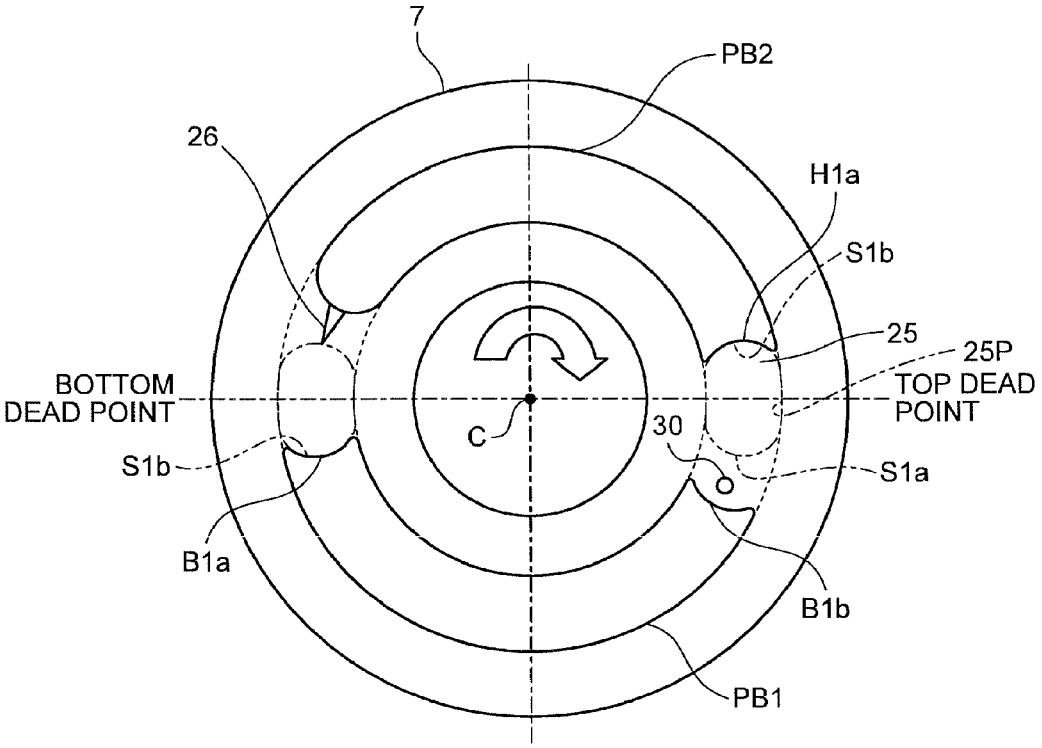
FIG. 6 is a view illustrating opening shapes of a valve plate suction port and a valve plate discharge port of a valve plate, with respect to a cylinder port, according to a first modification of the embodiment in the present invention.

In the embodiment described above, the opening shape Bib of the end portion on the rear side in the rotational direction of the valve plate suction port PB1 and the opening shape S1*a* of the end portion on the front side in the rotational direction of the cylinder port 25P have the same shape. As illustrated in FIG. 6, in a first modification, an opening shape B1*a* of an end portion on the front side in the rotational direction of a valve plate suction port PB1 and an opening shape H1*a* of an end portion on the front side in the rotational direction of a valve plate discharge port PB2 each have the same shape as an opening shape Sib of an end portion on the rear side in the rotational direction of a cylinder port 25P. That is, when the communication between the cylinder port 25P and the valve plate suction port PB1 is cut off in accordance with the rotation of the cylinder block 6, and when the communication between the cylinder port 25P and the valve plate discharge port PB2 is cut off, the opening shape S1*b* of the end portion on the rear side in the rotational direction of the cylinder port 25P overlaps an opening shape B1*a* of am end portion on the front side in the rotational direction of the valve plate suction port PB1 and an opening shape H1*a* of an end portion on the front side in the rotational direction of the valve plate discharge port PB2. As a result, the suction area and the discharge area can be larger than in the past.

When the communication between the cylinder port 25P and the valve plate suction port PB1 is cut off, the opening shape B1*a* of the end portion on the front side in the rotational direction, the opening shape H1*a* of the end portion on the front side in the rotational direction, and the opening shape S1*b* of the end portion on the rear side in the rotational direction may partially be the same, and the opening shape B1*a* and the opening shape H1*a* may each partially overlap the opening shape S1*b*. The opening shape B1*a* of the end portion on the front side in the rotational direction or the opening shape H1*a* of the end portion on the front side in the rotational direction may be the same or partially be the same as the opening shape S1*b* of the end portion on the rear side in the rotational direction.

As illustrated in FIG. 6, in order to enlarge the suction area and the discharge area as described above, it is preferable that the opening areas of the valve plate suction port PB1 and the valve plate discharge port PB2 be widened as much as possible so that the cylinder port 25P does not communicate with the valve plate suction port PB1 and the valve plate discharge port PB2 only when the cylinder port 25P is positioned at a top dead point and a bottom dead point. However, a circumferential rear end opening position of the valve plate suction port PB1 that includes a rotation assist region Δθ1 where a discharging process is shifted to a suction process is not limited to this. In a case where a notch 26 is provided on the valve plate discharge port PB2, the cylinder port 25P does not communicate with the tip end portion of the notch 26 only when the cylinder port 25P is positioned at the bottom dead point. The opening areas of the valve plate suction port PB1 and the valve plate discharge port PB2 are widened as much as possible so that the cylinder port 25P does not communicate with the valve plate suction port PB1 and the valve plate discharge port PB2 only when the cylinder port 25P is positioned at the top dead point and the bottom dead point; however, in consideration of manufacturing errors, it is preferable to separately position the ports PB1 and PB2 at a predetermined margin.

(Second Modification)

Figure 7:
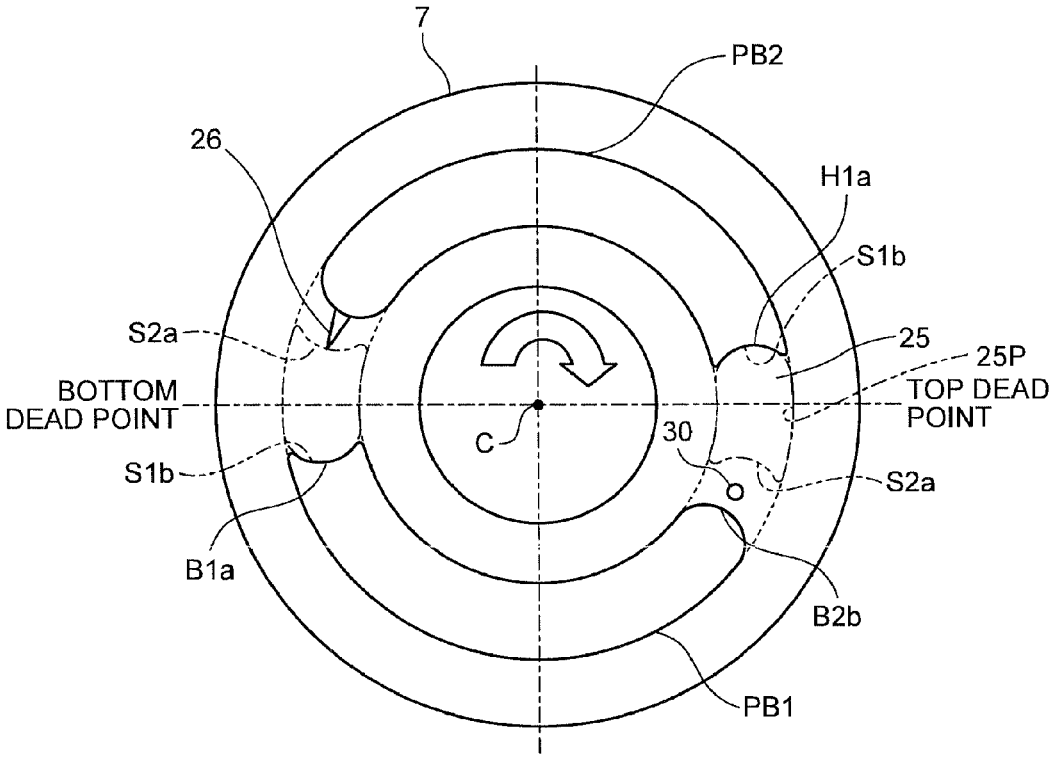
FIG. 7 is a view illustrating opening shapes of a valve plate suction port and a valve plate discharge port of a valve plate, with respect to a cylinder port, according to a second modification of the embodiment in the present invention.

According to a second modification, as illustrated in FIG. 7, the convex opening shape S1*a* of the end portion on the front side in the rotational direction of the cylinder port 25P is changed to a concave opening shape S2*a* of an end portion on the front side in the rotational direction, and the concave opening shape B1*b* of the end portion on the rear side in the rotational direction of the valve plate suction port PB1 is changed to a convex opening shape B2*b* of an end portion on the rear side in the rotational direction of a valve plate suction port PB1; therefore, the opening shape S2*a* of the end portion on the front side in the rotational direction and the opening shape B2*b* of the end portion on the rear side in the rotational direction have the same shape. That is, when a cylinder port 25P communicates with the valve plate suction port PB1 in accordance with the rotation of a cylinder block 6, the opening shape S2*a* of the end portion on the front side in the rotational direction of the cylinder port 25P and the opening shape B2*b* of the end portion on the rear side in the rotational direction of the valve plate suction port PB1 overlap. Similar to the first modification, when the communication between the cylinder port 25P and the valve plate suction port PB1 is cut off, and when the communication between the cylinder port 25P and the valve plate discharge port PB2 is cut off, an opening shape S1*b* of an end portion on the rear side in the rotational direction of the cylinder port 25P overlaps an opening shape B1*a* of an end portion on the front side in the rotational direction of the valve plate suction port PB1 and an opening shape H1*a* of an end portion on the front side in the rotational direction of the valve plate discharge port PB2. Also in this case, the opening shape S2*a* of the end portion on the front side in the rotational direction and the opening shape B2*b* of the end portion on the rear side in the rotational direction may partially be the same.

(Third Modification)

Figure 8:
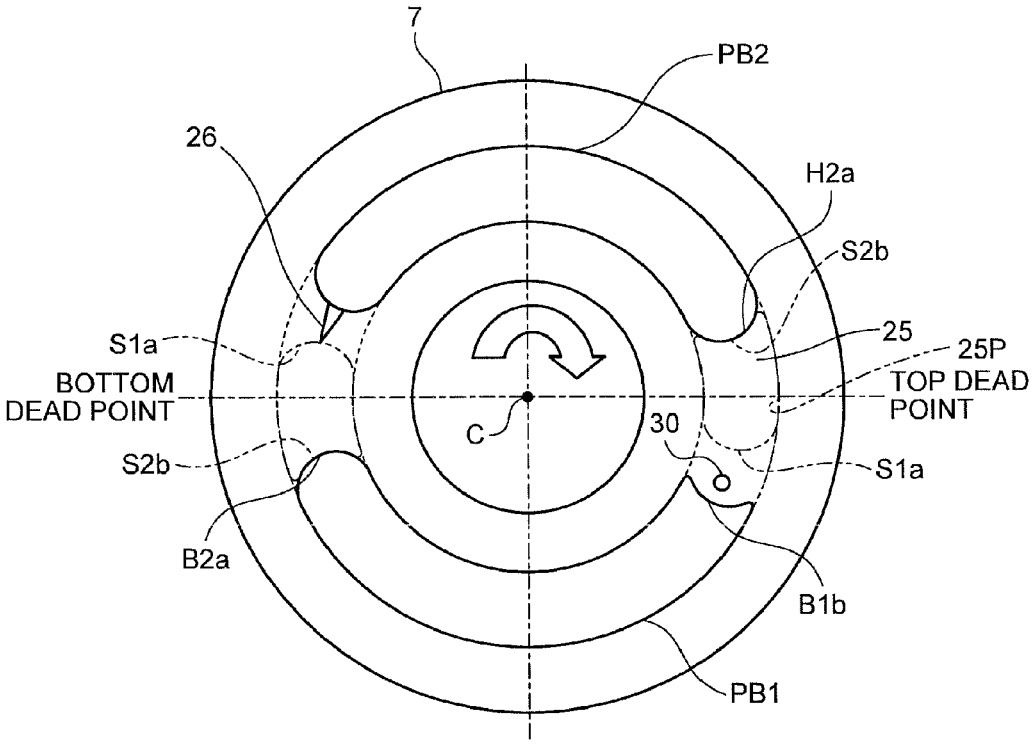
FIG. 8 is a view illustrating opening shapes of a valve plate suction port and a valve plate discharge port of a valve plate, with respect to a cylinder port, according to a third modification of the embodiment in the present invention.

According to a third modification, as illustrated in FIG. 8, an opening shape of an end portion on the front side in the rotational direction of a cylinder port 25P is a convex opening shape S1*a* of the end portion on the front side in the rotational direction, and an opening shape of an end portion on the rear side in the rotational direction of the cylinder port 25P is a concave opening shape S2*b* of the end portion on the rear side in the rotational direction. Accordingly, an opening shape of an end portion on the rear side in the rotational direction of a valve plate suction port PB1 is a concave opening shape B1*b* of the end portion on the rear side in the rotational direction, an opening shape of an end portion on the front side in the rotational direction of the valve plate suction port PB1 is a convex opening shape B2*a* of the end portion on the front side in the rotational direction, and an opening shape of an end portion on the front side in the rotational direction of a valve plate discharge port PB2 is a convex opening shape H2*a* of the end portion on the front side in the rotational direction. Furthermore, the opening shape S1*a* of the end portion on the front side in the rotational direction and the opening shape B1*b* of the end portion on the rear side in the rotational direction have the same shape. The opening shape S2*b* of the end portion on the rear side in the rotational direction and the opening shape B2*a* of the end portion on the front side in the rotational direction have the same shape. The opening shape S2*b* of the end portion on the rear side in the rotational direction and the opening shape H2*a* of the end portion on the front side in the rotational direction have the same shape. That is, when the cylinder port 25P communicates with the valve plate suction port PB1 and when the communication therebetween is cut off, and when the communication between the cylinder port 25P and the valve plate discharge port PB2 is cut off, one opening shape of the end portion in the port overlaps the other. Also in this case, the opening shapes may not have completely the same shape, but may partially have the same shape.

(Fourth Modification)

Figure 9:
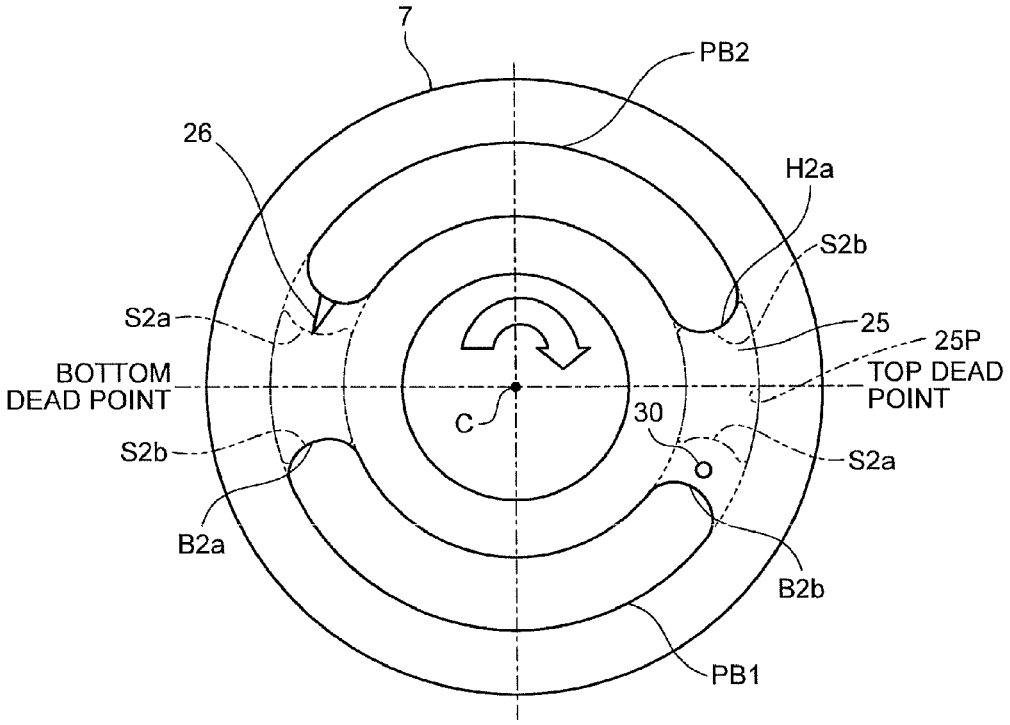
FIG. 9 is a view illustrating opening shapes of a valve plate suction port and a valve plate discharge port of a valve plate, with respect to a cylinder port, according to a fourth modification of the embodiment in the present invention.

According to a fourth modification, as illustrated in FIG. 9, an opening shape of an end portion on the front side in the rotational direction of a cylinder port 25P and an opening shape of an end portion on the rear side in the rotational direction of the cylinder port 25P are a concave opening shape S2*a* of the end portion on the front side in the rotational direction and a concave opening shape S2*b* of the end portion on the rear side in the rotational direction, respectively. Accordingly, an opening shape B2*b* of an end portion on the rear side in the rotational direction of a valve plate suction port PB1 has a convex shape, an opening shape B2*a* of an end portion on the front side in the rotational direction of the valve plate suction port PB1 has a convex shape, and an opening shape H2*a* of an end portion on the front side in the rotational direction of a valve plate discharge port PB2 has a convex shape. Furthermore, the opening shape S2*a* of the end portion on the front side in the rotational direction and the opening shape B2*b* of the end portion on the rear side in the rotational direction have the same shape. The opening shape S2*b* of the end portion on the rear side in the rotational direction and the opening shape B2*a* of the end portion on the front side in the rotational direction have the same shape. The opening shape S2*b* of the end portion on the rear side in the rotational direction and the opening shape H2*a* of the end portion on the front side in the rotational direction have the same shape. That is, when the cylinder port 25P communicates with the valve plate suction port PB1 and when the communication therebetween is cut off, and when the communication between the cylinder port 25P and the valve plate discharge port PB2 is cut off, one opening shape of the end portion in the port overlaps the other. Also in this case, the opening shapes may not have completely the same shape, but may partially have the same shape (Fifth Modification)

Figure 10:
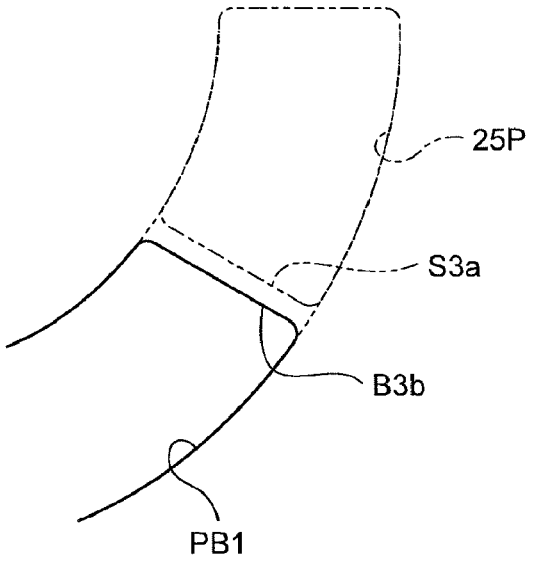
FIG. 10 is a view illustrating an example of an opening shape of a valve plate suction port with respect to a cylinder port according to a fifth modification of the embodiment in the present invention.
Figure 11:
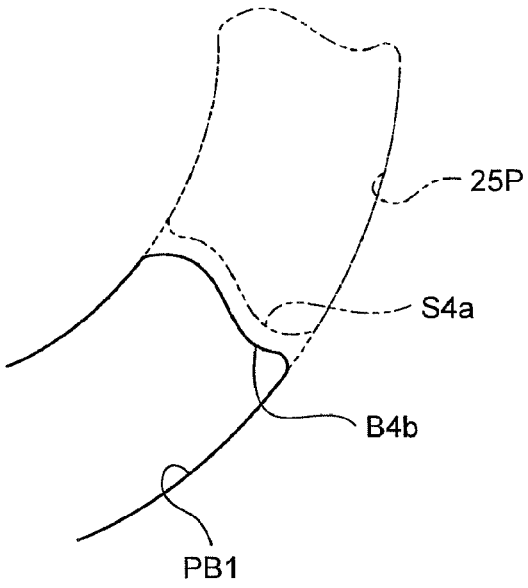
FIG. 11 is a view illustrating an example of an opening shape of the valve plate suction port with respect to the cylinder port according to the fifth modification of the embodiment in the present invention.

In the embodiment and first to fourth modifications described above, the opening shapes of the end portions on the front side and/or the rear side in the rotational direction have been circular convex shapes or circular concave shapes; however, the opening shapes of the end portions are not limited to these, and may be of any shape. For example, each opening shape may have the same shape with a straight line shape as an opening shape S3*a* of an end portion on the front side in the rotational direction of a cylinder port 25P and an opening shape B3*b* of an end portion on the rear side in the rotational direction of a valve plate suction port PB1 illustrated in FIG. 10. In addition, each opening shape may have the same shape with a wave shape having a convex/concave shape as an opening shape S4*a* of an end portion on the front side in the rotational direction of the cylinder port 25P and an opening shape B4*b* of an end portion on the rear side in the rotational direction of the valve plate suction port PB1 illustrated in FIG. 11. Also in these cases, the shapes may not have completely the same shape, but may partially have the same shape.

The convex shape or concave shape of the opening shape in the embodiment and first to fourth modifications described above includes an inverted U-shape or a U-shape, respectively.

The components of the embodiment and first to fifth modifications described above can be combined as appropriate.

In the embodiment and first to fifth modifications described above, the hydraulic pump has been described as an example; however, the invention is not limited to this, and can also be applied to a hydraulic motor. In the case of the hydraulic motor, a high-pressure side corresponds to a discharge side of the hydraulic pump, and a low-pressure side corresponds to a suction side of the hydraulic pump.

Also in this case, in accordance with the rotation of a cylinder block 6, when a cylinder port 25P communicates with a low-pressure port or when the communication therebetween is cut off, or when the communication between the cylinder port 25P and a high-pressure port is cut off, each opening shape of the end portion in the rotational direction in the port completely or partially overlaps.

Furthermore, in the embodiment and first to fifth modifications, the swash plate-type hydraulic pump/motor has been described as an example; however, the invention is not limited to this, and can also be applied to an inclined shaft-type hydraulic pump/motor.

REFERENCE SIGNS LIST

1 Shaft
2 Case
3 Swash plate
4 Shoe
5, 10 Piston
6 Cylinder block
7 Valve plate
8 End cap
9*a*, 9*b* Bearing
11 Spline structure
14 Ring
15 Spring
16 Movable ring
17 Needle
18 Pressing Member
20, 21 Shaft bearing
25 Cylinder bore
25P Cylinder port
26 Notch
30 Residual pressure release port
50 Partition plate
51 Shielding plate
L, L1 Flow path
P1 Suction port
P2 Discharge port
PB1 Valve plate suction port
PB2 Valve plate discharge port
S, Sa Sliding surface
S1*a*, S2*a*, S3*a*, S4*a* Opening shape of end portion on rear side in rotational direction of cylinder port
S1*b*, S2*b* Opening shape of end portion on rear side in rotational direction of cylinder port
B1*a*, B2*a* Opening shape of end portion on front side in rotational direction of valve plate suction port
B1*b*, B2*b*, B3*b*, B4*b* Opening shape of end portion on rear side in rotational direction of valve plate suction port
H1*a*, H2*a* Opening shape of end portion on front side in rotational direction of valve plate discharge port
T Working oil tank

The invention claimed is:

1. A hydraulic pump/motor in which a cylinder block with a plurality of cylinder bores formed around a rotation axis slides with respect to a valve plate including a high-pressure port and a low-pressure port, and which controls an amount of reciprocation of a piston in each of the cylinder bores depending on an inclination of a swash plate, wherein a first opening shape of the high-pressure port and a second opening shape of the low-pressure port extend circumferentially on a same arc centered around the rotation axis and are annular band shapes that do not include a top dead point and a bottom dead point, a third opening shape of a cylinder port in each of the cylinder bores extends circumferentially on a same arc where the high-pressure port and the low-pressure port are disposed, and is an annular band shape that does not communicate with the high-pressure port and the low-pressure port at least when positioned at the top dead point and the bottom dead point, a fourth opening shape of an end portion on a front side of the cylinder port and a fifth opening shape of an end portion of a rear side of the cylinder port with reference to a rotational direction of the cylinder block are circular convex shapes, a sixth opening shape of an end portion on a front side of the high-pressure port and a seventh opening shape of an end portion on a rear side of the high-pressure port in a rotational direction of the high-pressure port, and an eighth opening shape of an end portion on a front side of the low-pressure port in a rotational direction of the low-pressure port are circular convex shapes, a ninth opening shape of an end portion on a rear side of the low-pressure port in the rotational direction of the low-pressure port is a circular concave shape, and the fourth opening shape of the end portion on the front side of the cylinder port in a rotational direction of the cylinder port and the ninth opening shape of the end portion on the rear side of the low-pressure port in the rotational direction of the low-pressure port are a same shape.

2. A hydraulic pump in which a cylinder block with a plurality of cylinder bores formed around a rotation axis slides with respect to a valve plate including a high-pressure port and a low-pressure port, and which controls an amount of reciprocation of a piston in each of the cylinder bores depending on an inclination of a swash plate, wherein a first opening shape of the high-pressure port and a second opening shape of the low-pressure port extend circumferentially on a same arc centered around the rotation axis and are an annular band shape that does not include a top dead point and a bottom dead point, a third opening shape of a cylinder port in each of the cylinder bores extends circumferentially on the same arc where the high-pressure port and the low-pressure port are disposed, and is an annular band shape that does not communicate with the high-pressure port and the low-pressure port at the top dead point and the bottom dead point, a fourth opening shape of an end portion on a front side of the cylinder port and a fifth opening shape of an end portion of a rear side of the cylinder port with reference to a rotational direction of the cylinder block are circular convex shapes, a sixth opening shape of an end portion on a front side of the high-pressure port in a rotational direction of the high-pressure port is a circular concave shape, a seventh opening shape of an end portion on a rear side of the high-pressure port in the rotational direction of the high-pressure port is a circular convex shape, an eighth opening shape of an end portion on a front side of the low-pressure port and a ninth opening shape of an end portion of a rear side of the low-pressure port in a rotational direction of the low-pressure port are circular concave shapes, the fourth opening shape of the end portion on the front side of the cylinder port in a rotational direction of the cylinder port and the ninth opening shape of the end portion on the rear side of the low-pressure port in the rotational direction of the low-pressure port are a same shape, the fifth opening shape of the end portion on the rear side of the cylinder port in the rotational direction of the cylinder port, the eighth opening shape of the end portion on the front side of the low-pressure port in the rotational direction of the low-pressure port, and the sixth opening shape of the end portion on the front side of the high-pressure port in the rotational direction of the high-pressure port are a same shape, the valve plate further includes a residual pressure release port which communicates with each of the cylinder bores after each of the cylinder bores pass the top dead point and before each of the cylinder bores communicate with the low-pressure port, and a first opening portion of the end portion on the rear side of the low-pressure port in the rotational direction of the low-pressure port is separated from the top dead point so as to communicate with a second opening portion of an end portion on the front side of the cylinder port in the rotational direction of the cylinder port after passing a rotation assist region where rotation of the cylinder block is assisted by a pressure oil inside each of the cylinder bores from a top dead point position of the cylinder port and a residual pressure release region where a pressure inside each of the cylinder bores is decreased by a communication between the residual pressure release port and each of the cylinder bores and so as to shift to a suction process.

3. A hydraulic pump in which a cylinder block with a plurality of cylinder bores formed around a rotation axis slides with respect to a valve plate including a high-pressure port and a low-pressure port, and which controls an amount of reciprocation of a piston in each of the cylinder bores depending on an inclination of a swash plate, wherein a first opening shape of the high-pressure port and a second opening shape of the low-pressure port extend circumferentially on a same arc centered around the rotation axis and are an annular band shape that does not include a top dead point and a bottom dead point, a third opening shape of a cylinder port in each of the cylinder bores extends circumferentially on the same arc where the high-pressure port and the low-pressure port are disposed, and is an annular band shape that does not communicate with the high-pressure port and the low-pressure port at the top dead point and the bottom dead point, a fourth opening shape of an end portion on a front side of the cylinder port and a fifth opening shape of an end portion of a rear side of the cylinder port with reference to a rotational direction of the cylinder block are circular convex shapes, a combination of eighth and ninth opening shapes of end portions on a front side and a rear side of the low-pressure port in a rotational direction of the low-pressure port differs from a combination of sixth and seventh opening shapes of end portions on a front side and a rear side of the high-pressure port in a rotational direction of the high-pressure port, at least one of the eighth opening shape of the end portion on the front side and the ninth opening shape of the end portion on the rear side of the low-pressure port is a circular concave shape, when the eighth opening shape of the end portion of the front side of the low-pressure port in the rotational direction of the low-pressure port is a circular concave shape, the fifth opening shape of the end portion of the rear side of the cylinder port in a rotational direction of the cylinder port and the eighth opening shape of the end portion of the front side of the low-pressure port in the rotational direction of the low-pressure port are a same shape, when the ninth opening shape of the end portion of the rear side of the low-pressure port in the rotational direction of the low-pressure port is a circular concave shape, the fourth opening shape of the end portion of the front side of the cylinder port in the rotational direction of the cylinder port and the ninth opening shape of the end portion of the rear side of the low-pressure port in the rotational direction of the low-pressure port are a same shape, the valve plate further includes a residual pressure release port which communicates with each of the cylinder bores after each of the cylinder bores pass the top dead point and before each of the cylinder bores communicate with the low-pressure port, and a first opening portion of the end portion of on the rear side of the low-pressure port in the rotational direction of the low-pressure port is separated from the top dead point so as to communicate with a second opening portion of the end portion on the front side of the cylinder port in the rotational direction of the cylinder port after passing a rotation assist region where rotation of the cylinder block is assisted by a pressure oil inside each of the cylinder bores from a top dead point position of the cylinder port and a residual pressure release region where a pressure inside each of the cylinder bores is decreased by a communication between the residual pressure release port and each of the cylinder bores and so as to shift to a suction process.

* * * * *